United States Patent [19]

Drees et al.

[11] Patent Number: 5,027,851

[45] Date of Patent: Jul. 2, 1991

[54] SPOUT ASSEMBLY FOR HOT WATER DISPENSER

[75] Inventors: Steven C. Drees, Newton Township, Miami County; Mark R. Carey, Randolph Township, Montgomery County, both of Ohio

[73] Assignee: Whirlpool Corporation, Bent Harbor, Mich.

[21] Appl. No.: 554,254

[22] Filed: Jul. 17, 1990

[51] Int. Cl.[5] ..... F16L 5/00

[52] U.S. Cl. ..... 137/359; 137/801; 4/192

[58] Field of Search ..... 137/382, 359, 801, 315; 4/192

[56] References Cited

U.S. PATENT DOCUMENTS

| | | | |
|---|---|---|---|
| 302,022 | 7/1984 | Peck . | |
| 2,781,786 | 2/1957 | Young | 137/801 |
| 3,533,436 | 10/1970 | Parkison | 137/359 |
| 3,590,876 | 7/1971 | Young | 137/801 |
| 3,620,241 | 11/1971 | Brown | 137/801 |
| 3,871,406 | 3/1975 | Anderson | 137/801 |
| 4,290,445 | 9/1981 | Turner | 137/801 |
| 4,649,958 | 3/1987 | Purcell | 137/801 |
| 4,685,487 | 8/1987 | Derdack et al. | 137/315 |
| 4,722,509 | 2/1988 | Delker et al. | 251/368 |
| 4,889,165 | 12/1989 | Newcombe et al. | 137/801 |

FOREIGN PATENT DOCUMENTS

| | | | |
|---|---|---|---|
| 3522390 | 1/1987 | United Kingdom | 4/192 |

*Primary Examiner*—A. Michael Chambers
*Attorney, Agent, or Firm*—Jeffers, Hoffman & Niewyk

[57] ABSTRACT

A spout assembly for a hot water dispenser having a valve body including an outlet and a sealed valve assembly for controlling liquid flow within the valve body. A liquid conduit is connected to the outlet. A spout cover is removably disposed over the valve body and the liquid conduit such that the spout cover may be removed from the valve body without disturbing the seal of the valve assembly.

17 Claims, 1 Drawing Sheet

SPOUT ASSEMBLY FOR HOT WATER DISPENSER

BACKGROUND OF THE INVENTION

This invention relates to a hot water dispenser and more particularly to a hot water dispenser of the type mountable on a sink fixture. In particular, this invention relates to a spout cover for such a hot water dispenser.

Hot water dispensers are well known in the prior art and are used for a great variety of purposes, i.e., to prepare instant foods, speed the cooking of foods, loosen jar lids, fill hot water bottles, etc. In essence, hot water dispensers create convenience and time savings for many different tasks. Since hot water dispensers are generally installed in the kitchen, it is desired that the dispenser decoratively match other kitchen appliances, such as sinks, countertops, or cabinets.

Generally, hot water dispensers include a unitary nozzle body which is generally cylindrical and provides decorative features of the dispenser. One type of commercially successful hot water dispenser utilizing a unitary decorative spout is the Instant-Hot (TM) hot water dispenser manufactured by KitchenAid (TM).

If one wishes to redecorate a kitchen in which an existing hot water dispenser is installed, it also may be desired to change the color of the nozzle body, thus requiring installation of a new nozzle body. In addition, a new nozzle body may be desired for many other reasons such as damage to the existing nozzle body or deterioration due to excessive use.

Existing methods of changing the color of a hot water dispenser require that the valve body of the dispenser be removed from the sink and the plumbing disconnected. Thus, the entire valve assembly must be disconnected which is very difficult and time consuming.

It is thus desired to provide a hot water dispenser in which the color of the nozzle body may be quickly and inexpensively changed.

SUMMARY OF THE INVENTION

The present invention improves on the above-described prior art by providing a liquid dispenser having a spout cover which is adapted to coaxially receive the valve body of the dispenser and wherein the spout cover may be easily removed from the valve body for convenient replacement.

More particularly, the present invention provides a spout assembly for a hot water dispenser having a valve body and a liquid conduit projecting from an aperture disposed within the valve body. The valve body is substantially telescopingly received within the spout cover. The spout cover is attached to the valve body by a removable fastener to allow the spout cover to be removed from the valve body, which remains attached to the plumbing.

One advantage of the spout assembly of the present invention is that a decorative spout cover is provided which is easily removed or interchanged depending upon user or marketing needs.

Another advantage of the spout assembly of the present invention is that the spout cover may be removed without disconnecting the valve assembly or disturbing the seal of the valve assembly or nozzle, thereby eliminating the requirement of a service call for the purpose of interchanging the spout covers.

Still another advantage of the spout assembly of the present invention is that the spout cover is automatically aligned on the valve body, thus eliminating the need to manually align their corresponding apertures.

The present invention in one form thereof, comprises a spout assembly for a liquid dispenser including a valve body having an outlet and a sealed valve assembly for controlling the flow of liquid within the valve body. A stem is provided on the valve assembly for selectively actuating the valve assembly. A dispensing tube projecting from an aperture disposed within the valve assembly transports the liquid contained within the valve body. A spout cover is removably disposed over the valve body and dispensing tube.

The present invention in one form thereof, further comprises a spout assembly for a liquid dispenser including a valve body adapted to be mounted on a surface and having an outlet and a sealed valve assembly for controlling the flow of liquid within the valve body. A stem is provided on the valve assembly for selectively actuating the valve assembly. A plastic dispensing tube projecting from an aperture disposed within the valve assembly is connected to the outlet and transports the liquid contained within the valve body. A spout cover is removably disposed over the valve body and dispensing tube by a removable fastener secured to the valve body. The valve body is substantially telescopingly received within the spout cover.

It is an object of the present invention to provide a spout assembly wherein the spout cover for the nozzle body may be quickly and inexpensively changed.

Another object of the present invention is to provide a spout assembly in which the cover of the nozzle body may be changed without disconnecting the valve assembly or disturbing the seal of the valve assembly.

Still another object of the present invention is to provide a spout assembly in which the cover of the nozzle body may be changed without requiring the services of a plumber.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

Figures 1, 2:
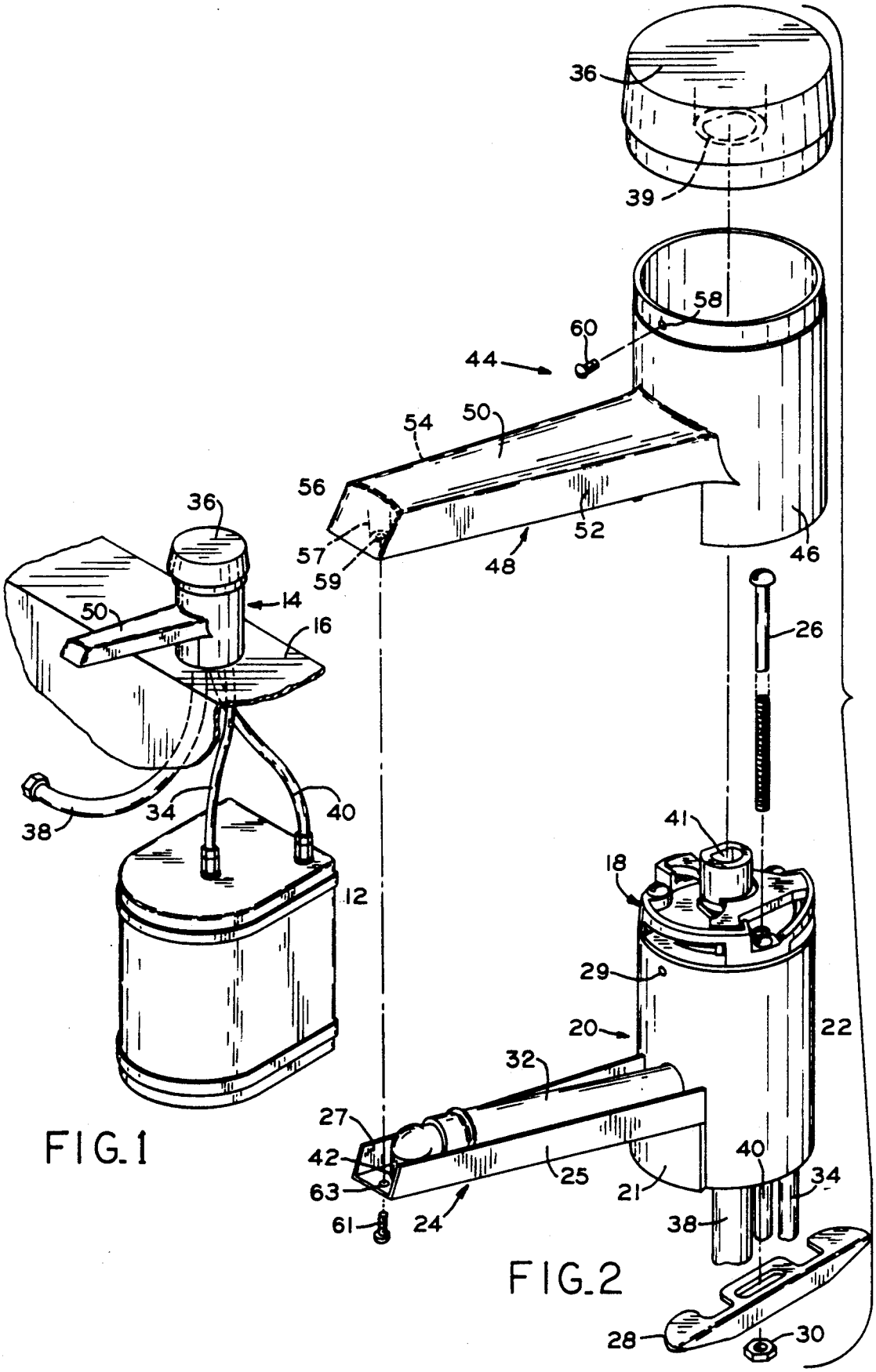
FIG. 1 is a perspective view of the decorative spout assembly of the present invention mounted on a surface partially broken away to show the hot water tank.
FIG. 2 is an exploded perspective view of the spout assembly particularly illustrating the decorative spout cover of the present invention.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring to FIGS. 1 and 2, a hot water dispenser is shown having a remote hot water holding tank 12 and a nozzle body 14 mounted on a surface 16 (e.g. a sink flange). Nozzle body 14 includes a rotary valve assembly 18 contained within a valve body 20, which comprises a raised portion 21 and generally cylindrical portion 22 open at each end and having a threaded aperture 29 therein. Valve body 20 further includes a dispensing nozzle 24 having upwardly extending sides 25 and 27. Valve body 20 is secured to surface 16 by mounting screw 26 which extends axially through valve assembly 18 and through a mounting bracket 28. Nut 30 secures screw 26 in place. Also contained within nozzle body 14 is an inlet tube 34 for carrying heated water. The tube may be formed of a pliable plastic material, such as Tygon (TM) or an appropriate substitute. Inlet tube 34 extends upwardly from tank 12 and through an aperture disposed in cylindrical portion 22. Inlet tube 34 supplies dispensing tube 32, wherein tubes 34 and 32 form a continuous conduit therewith.

Valve assembly 18 is actuated by a twistable cap 36, located at the upper end of nozzle body 14 that selectively controls the flow of heated water. Cap 36 includes a downwardly opening socket portion 39 which coaxially surrounds and grips stem portion 41 of valve assembly 18. When cap 36 is turned clockwise, stem 41 is also turned clockwise to open the cold water inlet valve (not shown). The inlet valve is spring biased in the closed position so that the user need only release cap 36 to close the inlet valve and stop the flow of water to the dispenser. Alternatively, an inlet valve and cap using a nonrotary actuation motion may be provided.

To use the hot water dispenser, cap 36 is turned to open the cold water inlet valve. Cold water is then delivered from supply line 38 into an anti-liming system (not shown) in tank 12 via supply line 40. Cold water continues to flow out the bottom of the anti-liming system and into the bottom of tank 12 toward hot water inlet tube 34. The cold water forces the heated water in tank 12 into inlet tube 34, through dispensing tube 32, and out water spout 42 of dispensing nozzle 24. When cap 36 is released, the inlet valve is closed.

Referring now to FIG. 2, there is shown a spout cover 44 which may be formed from a hard plastic material and including a cylindrical portion 46 which is open at both ends. The cover may be decorative in appearance and may be available in various colors and materials as desired. Cover 44 further includes an outwardly projecting nozzle portion 48. Nozzle portion 48 comprises a top portion 50, downwardly extending side portions 52 and 54, and a downwardly extending end portion 56. A cylindrical projection 57, having a bore 59 therein, is integrally formed on the inner surface of end portion 56. When assembled, cylindrical portion 22 of valve body 20 is telescopingly received into cylindrical portion 46 of spout cover 44, and downwardly extending side portions 52 and 54 overlap respective upwardly extending sides 25 and 27. Further, cylindrical portion 46 and raised portion 21, when combined, provide a flush exterior surface and improved appearance. Aperture 58 automatically lies directly over aperture 29 to allow hold-down screw 60 to releasably secure spout cover 44 to valve body 20. Nozzle portion 48 and dispensing nozzle 24 are secured to one another by screw 61 which extends through aperture 63 in nozzle 24 and into threaded bore 59. Cap member 36 is then snapped into cylindrical portion 46.

In accordance with the present invention, spout cover 44 may be conveniently and inexpensively changed without changing the complete spout assembly. First, cap member 36 is pulled off cylindrical body 46. Screw 61 is removed from bore 59 and aperture 63. Screw 60 is then removed from apertures 58 and 29, and spout cover 44 is pulled up and away from valve body 20, which remains attached to surface 16. A new decorative spout cover 44' (not shown) is then slid over valve body 20. Spout cover 44' is automatically aligned with valve body 20 by the fitting of outwardly projecting nozzle portion 48 over dispensing nozzle 24, thus eliminating the need to manually align apertures 58 and 29. Spout cover 44' is then secured to valve body 20 by screws 60 and 61. A new color cap 36' (not shown) is then snapped over cylindrical portion 46.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and falls within the limits of the appended claims.

What is claimed is:

1. A spout assembly for a liquid dispenser comprising:
   a valve body including an outlet and a sealed valve assembly for controlling liquid flow within said valve body;
   means for selectively actuating said valve assembly;
   a liquid conduit connected to said outlet;
   support means secured to said valve body for supporting said liquid conduit; and
   an integrally formed spout cover removably disposed over and surrounding said valve body and said liquid conduit, said spout cover being attachable to said support means and removable independent of said liquid conduit.

2. The spout assembly of claim 1, wherein said support means comprises an upwardly opening U-shaped trough.

3. The spout assembly of claim 2, wherein said spout cover includes an outwardly projecting nozzle portion which covers said U-shaped trough.

4. The spout assembly of claim 1, wherein said valve body is substantially telescopingly received within said spout cover.

5. The spout assembly of claim 1, wherein said spout cover is secured to said valve assembly by a removable fastener.

6. The spout assembly of claim 1, wherein said liquid conduit means comprises a plastic dispensing tube projecting from an aperture disposed in said valve body.

7. A spout assembly for a liquid dispenser comprising:
   a valve body adapted to be mounted on a surface and including an outlet and a sealed valve assembly for controlling liquid flow within said valve body;
   means for selectively actuating said valve assembly;
   a liquid conduit connected to said outlet, said conduit projecting from an aperture disposed within said valve body;
   support means secured to said valve body for supporting said liquid conduit; and
   an integrally formed spout cover removably disposed over and surrounding said valve body and said liquid conduit, said spout covering being attachable to said support means and removable independent of said liquid conduit.

8. The spout assembly of claim 7, wherein said support means comprises an upwardly opening U-shaped trough.

9. The spout assembly of claim 8, wherein said spout cover includes an outwardly projecting nozzle portion which covers said U-shaped trough.

10. The spout assembly of claim 7, wherein said valve body is substantially telescopingly received within said spout cover.

11. The spout assembly of claim 7, wherein said spout cover is secured to said valve assembly by a removable fastener.

12. The spout assembly of claim 7, wherein said liquid conduit comprises a plastic dispensing tube.

13. A spout assembly for a liquid dispenser comprising:

a valve body including an outlet and a sealed valve assembly for controlling liquid flow within said valve body;

means for selectively actuating said valve assembly;

a liquid conduit connected to said outlet;

support means secured to said valve body for supporting said liquid conduit; and an integrally formed spout cover removably disposed over and surrounding said valve body and said liquid conduit, said spout cover being attachable to said support means and removable independent of said liquid conduit said valve body being substantially telescopingly received within said spout cover.

14. The spout assembly of claim 13, wherein said support means comprises an upwardly opening U-shaped trough.

15. The spout assembly of claim 14, wherein said spout cover includes an outwardly projecting nozzle portion which covers said U-shaped trough.

16. The spout assembly of claim 13 wherein said spout cover is secured to said valve assembly by a removable fastener.

17. The valve assembly of claim 13, wherein said liquid conduit means comprises a plastic dispensing tube projecting from an aperture disposed in said valve body.

* * * * *